United States Patent [19]

McBean

[11] 3,969,906

[45] July 20, 1976

[54] TUNNELLING SHIELDS

[75] Inventor: Rupert John Sidney McBean, Croydon, England

[73] Assignee: Charcon Tunnels Limited, Great Britain

[22] Filed: Sept. 13, 1974

[21] Appl. No.: 505,947

Related U.S. Application Data

[62] Division of Ser. No. 336,332, Feb. 27, 1973, Pat. No. 3,850,000.

[30] Foreign Application Priority Data

Mar. 2, 1972 United Kingdom ..... 9751/72

[52] U.S. Cl. ..... 61/85; 61/42

[51] Int. Cl.[2] ..... E01G 3/00

[58] Field of Search ..... 61/45 R, 84, 85, 63, 61/42

[56] References Cited

UNITED STATES PATENTS

| | | | |
|---|---|---|---|
| 770,894 | 9/1904 | Dutton | 61/45 R |
| 1,336,789 | 4/1920 | Sheen | 61/84 X |
| 1,624,369 | 4/1927 | Serra | 61/45 R X |
| 1,881,421 | 10/1932 | Coyle | 61/45 R |
| 2,804,754 | 9/1957 | Bridge | 61/84 |
| 2,895,299 | 7/1959 | Washabaugh | 61/45 R |

FOREIGN PATENTS OR APPLICATIONS

| | | | |
|---|---|---|---|
| 182,115 | 5/1955 | Austria | 61/85 |
| 1,238,576 | 7/1971 | United Kingdom | 61/85 |

*Primary Examiner*—Dennis L. Taylor
*Attorney, Agent, or Firm*—Cushman, Darby & Cushman

[57] ABSTRACT

A tunnelling shield has a rearward rotatable part having a spiral rearward end to engage a forward end of a spiral tunnel lining. A drive mechanism rotates the rearward shield part as further tunnel segments are laid one by one in the shield end against the previous segment to be erected. Rams advance the shield as the rearward end rotates to allow a newly erected segment to engage the tunnel wall.

2 Claims, 9 Drawing Figures

TUNNELLING SHIELDS

BACKGROUND OF THE INVENTION

This is a division of application Ser. No. 336,332 field February 27, 1973, now U.S. Pat. No. 3,850,000.

1. Field of the Invention

This invention relates to tunnelling shields for use in erecting a spiral tunnel lining.

2. Description of the Prior Art

Tunnelling shields for erecting spirally wound tunnel linings are known in which one or more turns of the spiral are erected in the rearward end of the shield and the shield is advanced by rams pushing on the end of the erected lining. In practice it has been found necessary to erect a number of segments and then advance the shield followed by a further erection operation so that the shield advances step by step between the operations of erecting segments. Furthermore on withdrawing the shield from around the lining a void is left which must be filled with grout or the wall of the tunnel could collapse against the lining and exert a nonuniform pressure on the lining which could cause the lining to collapse at that location. U.S. Pat. No. 739969 is representative of the above prior art.

SUMMARY OF THE INVENTION

The invention provides a tunnelling shield for use in erecting a spiral tunnel lining, the shield being of cylindrical form and having forward and rearward parts which are rotatable relatively to one another about the shield axis, the rearward part of the shield having a trailing end which has a spiral form extending between a step facing generally around the shield, so that in use the end of the shield can engage a partially erected spiral lining to support the ground adjacent the lining and each additional segment can be located in the shield adjacent said step and attached to the previously erected segment, the shield having means for rotating said rearward part of the shield with respect to the forward part of the shield in the opposite direction to which the step faces to withdraw the shield from the newly erected segment and means to advance the shield along the tunnel simultaneously with said rotation of the rearward part of the shield.

DESCRIPTION OF THE PREFERRED EMBODIMENTS

Figure 1:
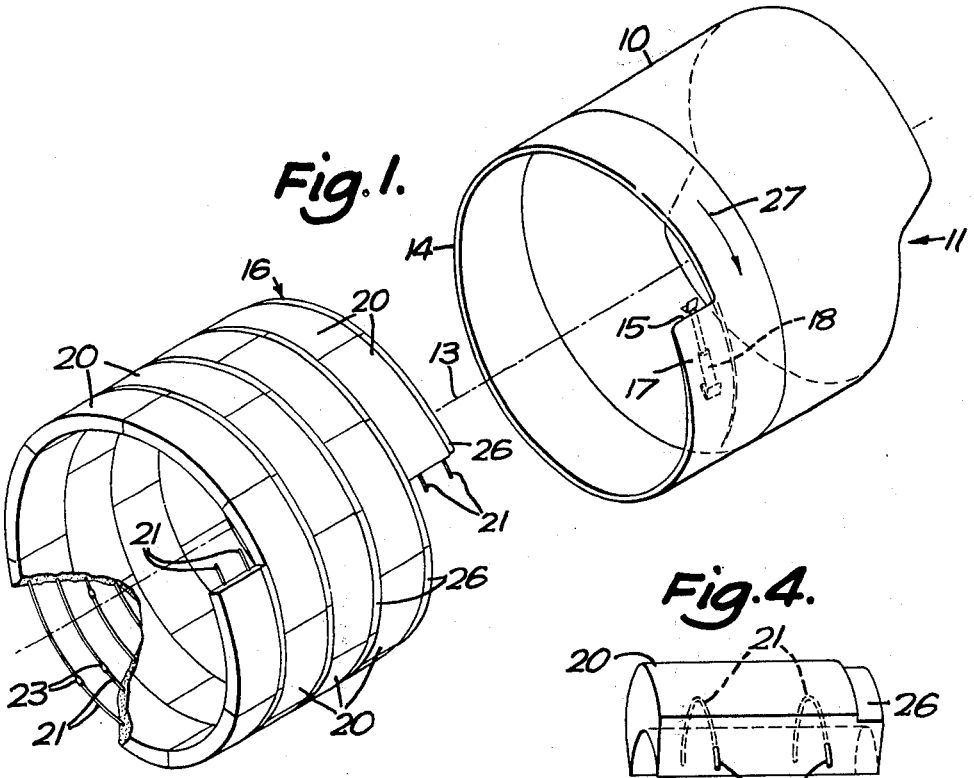
FIG. 1 is a perspective view of a tunnelling shield and partially erected tunnel lining.

Referring firstly to FIG. 1 of the drawings there is shown a tunnelling shield comprising a forward portion 10 which is provided with a conventional earth cutting mechanism (not shown) in the leading end of the shield indicated at 11.

The shield has a tail portion 12 which is mounted on the shield for rotation with respect to the shield about the shield axis 13. The trailing edge 14 of the tail 12 has a contour of one turn of a spiral and the ends of the spiral are connected by a step in the contour 15. The spiral is equivalent to that of spirally wound tunnel lining indicated generally at 16. The internal diameter of the tail over a portion 17 of the tail adjacent the step 16 gradually increases towards the step 15 so that the tail tapers to an edge at the step 15.

A number of hydraulic rams (not shown) are mounted around the inner surface of the shield 10 generally parallel to the axis 13 and act through the tail 14 on the end of the patially erected lining 16 to advance the shield 10 as the tail 10 is rotated as described later. Rotation of the tail with respect to the shield is effected by a hydraulic ram 18 mounted on the inner surface of the portion 17 of the tail to act circumferentially against a previously erected segment.

Figure 4:
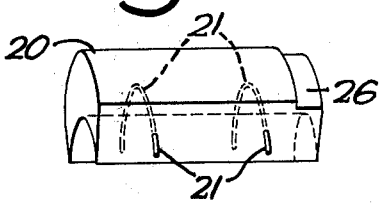
FIG. 4 is a perspective view of the segment.
Figure 2:
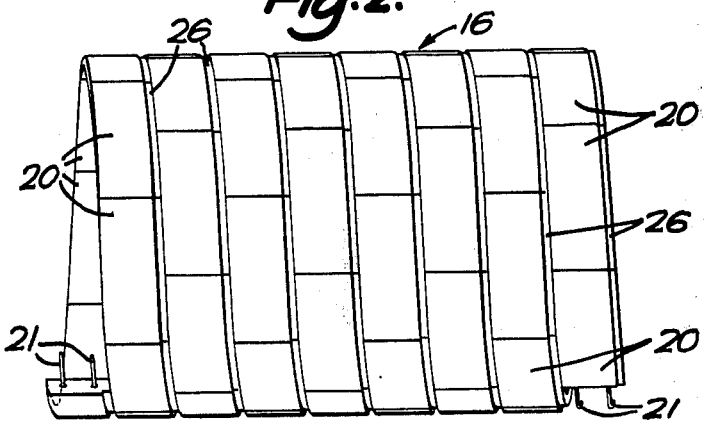
FIG. 2 is a plan view of the partially erected lining.
Figure 3:
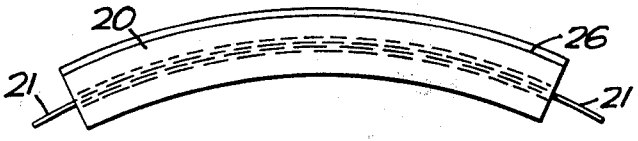
FIG. 3 is a side view of one segment of the lining.
Figure 5:
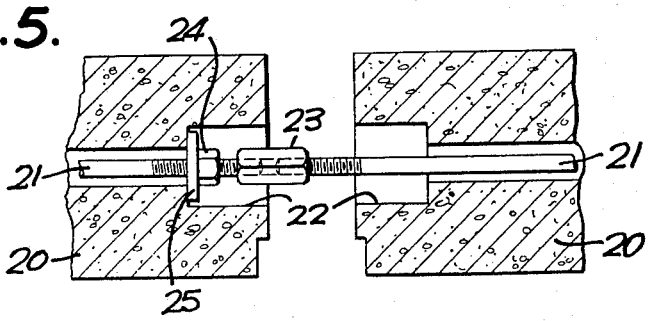
FIG. 5 is a detailed view of the attachment between two segments.

The tunnel lining comprises a spiral of separate segments 20 one of which is shown in detail in FIGS. 3 and 4. The segment is formed in pre-cast concrete or any other suitable material and two axially spaced bores are cast in the segment through which tie bars 21 for joining adjacent segments together extend. A joint between two adjacent segments is illustrated in FIG. 5 of the drawings and it will be seen that the bores through which the tie bars 21 extend are counterbored as indicated at 22 at the ends of the segments. The ends of the tie bars are screw threaded and are connected together by a screw threaded coupler 23. The left hand segment 20 is secured to its tie bar by a nut 24 and washer 25 on the tie bar which are tightened against the bottom of the counterbore to clamp the segment 20 against the previously erected segment. The right hand segment 20 is clamped firmly against the left hand segment 20 in a similar manner. The adjancent circumferential edges of the segments have conventional interlocking tongues and sockets to lock the segments together.

As will be seen in FIGS. 3 and 4 the outer peripheral edge of each segment 20 which, when erected, temporarily forms the leading edge of the tunnel lining has a rebate 26 in which the trailing edge of the tail 12 of the shield engages. The outer diameter of the shield 10 is substantially the same as that of the erected lining 16. Thus there is no void around the lining to be filled with grout and the tunnel is continuously supported by the shield, the tail or the lining.

The method of erection of the tunnel lining will now be described. It is assumed that the cutter mechanism at the leading end of the shield has excavated sufficient earth at the tunnel face to enable th shield 10 to be advanced. During erection of the tunnel lining the trailing edge of the tail 13 engages in the rebate 26 around the periphery of the leading end of the partially erected lining. The free end of the last segment 20 to be erected projects into the tail 12 over the step 15. A new segment 20 to be erected is offered up to the free end of the last segment to be erected and is connected thereto as described earlier with reference to FIG. 5. The shield is advanced by the action of the hydraulic rams against the leading edge of the partially erected lining and simultaneously the tail is rotated in the direction of the arrow 27 to withdraw the tail from the newly erected segment until only the free end of the newly erected segment projects into the tail. The rate of advancement of the shield 10 and rotation of the tail 12 are so controlled that the trailing edge of the tail 12 remains throughout in engagement in the rebate 26 in the leading end of the lining.

It will be appreciated from the above method that the wall of the tunnel is continuously supported by the forward part of the shield 10, or the tail 12 or the lining 16. Thus the ground around the tunnel is continuously supported to prevent any movement of the ground. Further since the diameter of the shield and tail is equal to that of the lining no void is left around the lining by the shield to be filled with grout.

It will be appreciated that many modifications may be made to the above apparatus without departing from the scope of the invention. For example the tail may be rotated with respect to the shield by a rotary drive mechanism mounted within the shield. One such mechanism is illustrated in FIGS. 6 to 9 to which reference will now be made.

Figure 7:
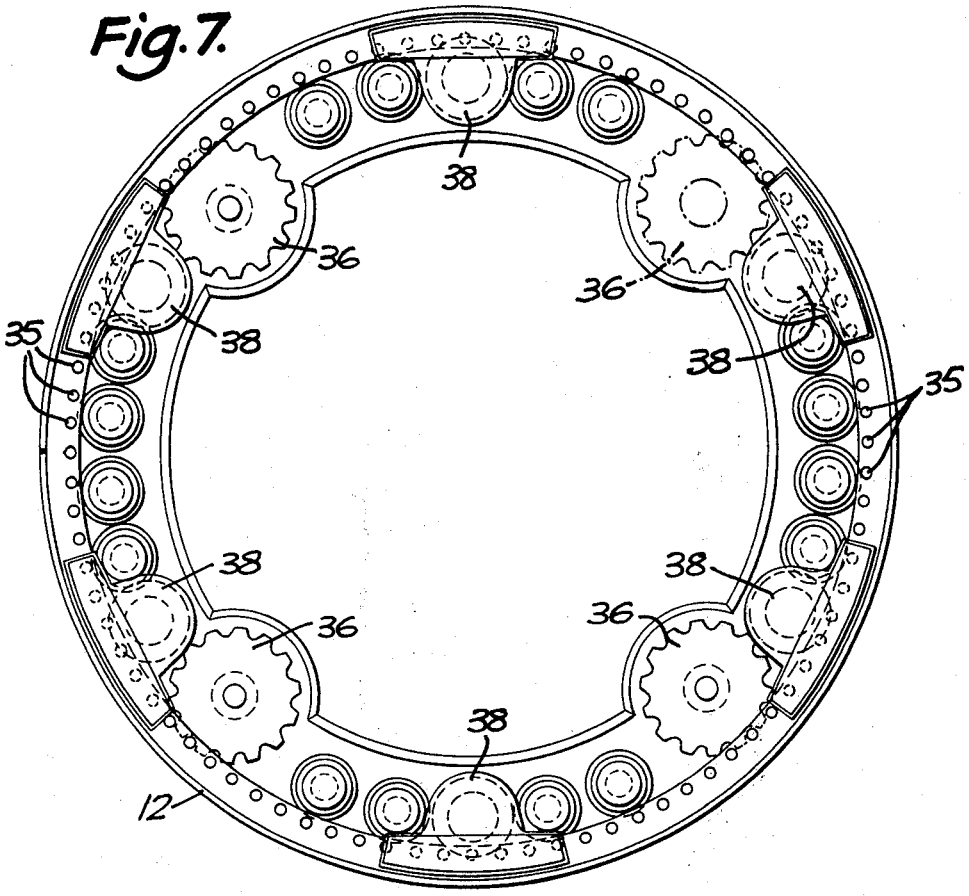
FIG. 7 is a view looking in the direction of the arrow X on FIG. 6.

The tunnelling shield is generally similar to that described above and like parts have been given the same reference numerals. The main difference lies in the arrangement for driving and supporting the tail part 12 of the shield 10. The tail part of the shield is supported for rotation with respect to the forward part of the shield by rollers 30 which project from the rearward end of the forward part of the shield and are rotatably mounted on axles 31 which are rigidly mounted parallel to the shield axis on annular webs 32 extending around the inner surface of the forward portion. A number of groups of rollers are provided around the shield as can be seen in FIG. 7. The tail portion of the shield has two spaced annular track elements 33 which the rollers engage and each roller 30 has a central encircling enlargement 34 which engages between the track elements 33 so that the tail portion 12 is constrained against axial movement with respect to the forward portion of the shield.

Figure 9:
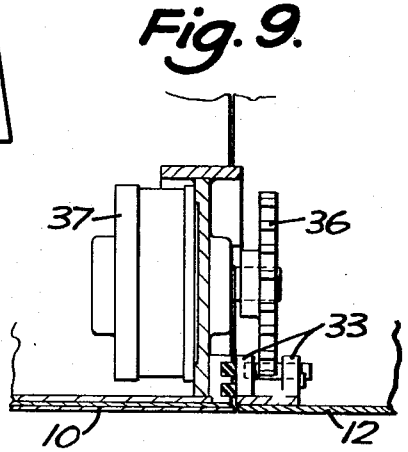
FIG. 9 is a further detail view of part of the shield of FIG. 6.
Figure 6:
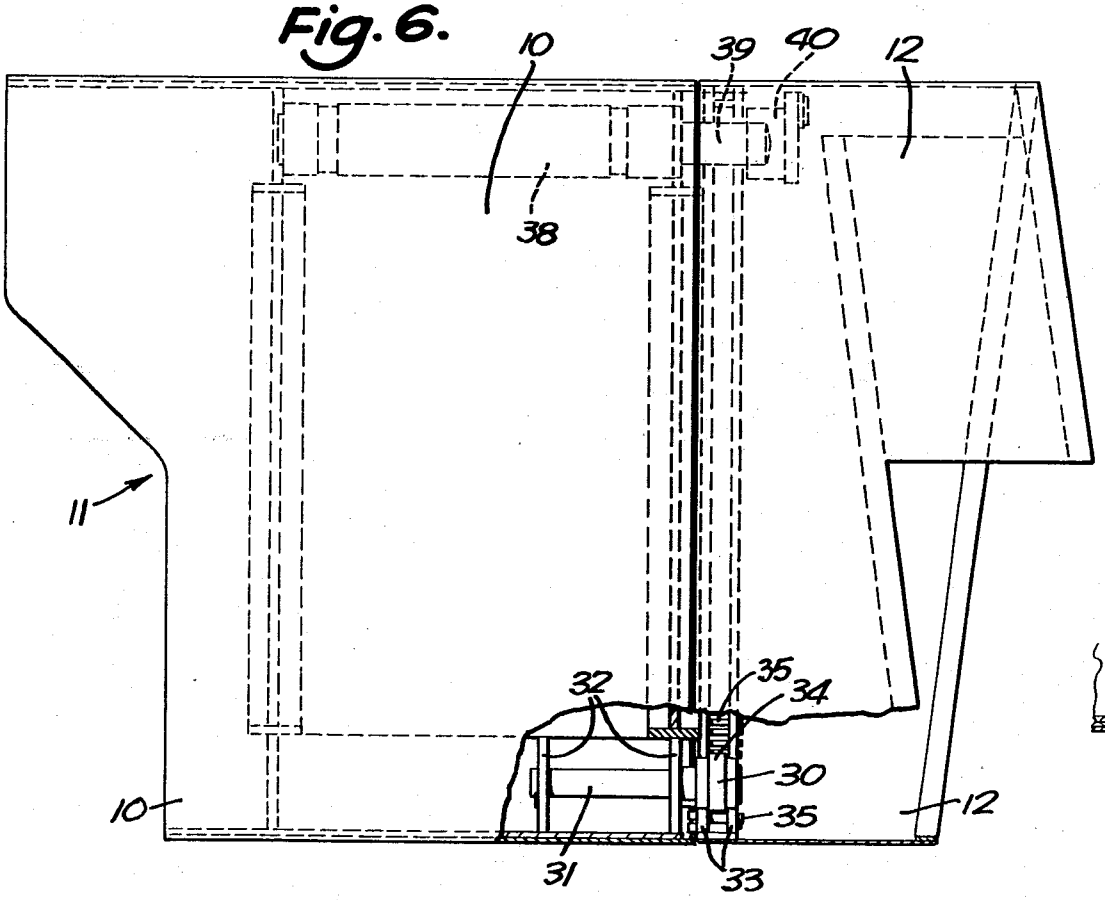
FIG. 6 is a diagrammatic side view of a modified form of tunnelling shield.

A number of fixed pins 35 extend between the track elements 33 to form a rack around the inner surface of the tail portion of the shield which is engaged by a plurality of pinions 36 driven by hydraulic fluid motors 37 mounted on the forward part of the shield as shown in FIG. 9. The pinions 36 and motors 37 are located between the groups of rollers 30 as can be seen in FIG. 7. Also located between the groups of rollers 30 there are hydraulic rams 38 which extend axially along the inner surface of the forward portion of the shield 10 each ram having a push rod 39 extending rearwardly of the forward portion of the shield through the tail portion of the shield, the push rod carrying a presser member 40 at its rearward end for engaging the forward end of the newly erected tunnel lining to drive the tunnelling shield forward as the tail portion of the shield 12 is rotated.

Figure 8:
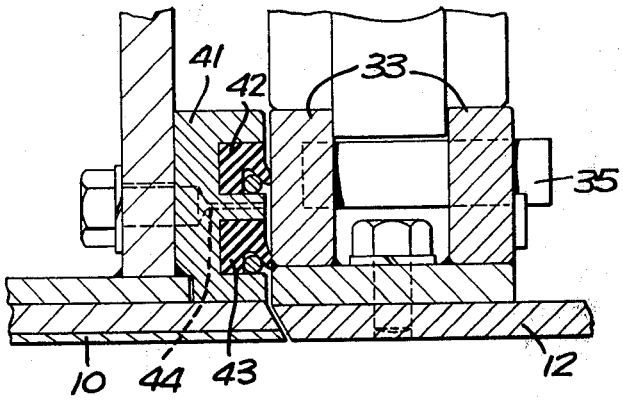
FIG. 8 is a detail view of part of the shield shown in FIG. 6.

FIG. 8 of the drawings shows in detail the joint between the forward and tail portions of the shield. As shown, there is an annular ring 41 around the inner surface of the rearward end of the shield portion 10 which is closely spaced from the track member 33 on the tail portion of the shield. The ring carries two annular lip seals 42, 43 the lips of which bear on the adjacent side of the track element 33 to prevent ingress of matter between the two shield portions. There are a number of passageways 44 through the ring 41 which opens into the space between the two seals to deliver liquid bentonite into the space under pressure. The outer seal 43 allows the bentonite to escape through the gap between the shield portions to reach the outer surface of the shield and in so doing it removes any spoil between the portions of the shield and the bentonite acts as a lubricant for the outer surface of the shield. The inner seal 42 prevents any bentonite escaping inwardly between the shield portions.

What we claim is:

1. An arcuate tunnel lining segment for a spiral tunnel lining, the segment having circumferential edges which extend along parallel spiral paths, each edge having an outerside and an inner side; and a single rebate formed along the outer side of only one of the circumferential edges of the segment to receive a spiral trailing edge of a tunnelling shield so that the outside dimensions of the shield and the segment are substantially the same as the dimensions of the tunnel being formed so that no grouting is necessary between the outerside of the lining and the tunnel, the rebate having a radial depth which is relatively small in relation to the radial depth of the remainder of said one edge so that a bearing surface is provided on said one edge for action of hydraulic rams on said one edge to move the shield forward as the tunnelling advances, the other circumferential edge of the segment being plain.

2. A tunnel lining segment as claimed in claim 1 wherein the segment has one or more openings extending circumferentially through the segment and wherein the or each opening has a tie bar for securing adjacent segments together end to end.

* * * * *